US007038200B2

(12) United States Patent
Nikolaev

(10) Patent No.: US 7,038,200 B2
(45) Date of Patent: May 2, 2006

(54) ION CYCLOTRON RESONANCE MASS SPECTROMETER

(75) Inventor: Evgenij Nikolaev, Moscow (RU)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 10/833,938

(22) Filed: Apr. 28, 2004

(65) Prior Publication Data

US 2005/0242280 A1 Nov. 3, 2005

(51) Int. Cl.
*H01J 49/38* (2006.01)
*H01J 49/14* (2006.01)

(52) U.S. Cl. ..... 250/291; 250/281; 250/282; 250/290; 250/293; 250/299; 250/300

(58) Field of Classification Search ..... 250/281, 250/282, 290–293, 299–300
See application file for complete search history.

(56) References Cited

U.S. PATENT DOCUMENTS 4,686,365 A * 8/1987 Meek et al. ..... 250/281
5,340,983 A * 8/1994 Deinzer et al. ..... 250/281
5,493,115 A * 2/1996 Deinzer et al. ..... 250/281
6,403,955 B1 * 6/2002 Senko ..... 250/292
6,784,421 B1 * 8/2004 Park ..... 250/281
2003/0025074 A1 * 2/2003 Li ..... 250/288
2004/0155180 A1 * 8/2004 Zubarev ..... 250/281
2005/0242280 A1 * 11/2005 Nikolaev ..... 250/291

* cited by examiner

*Primary Examiner*—John R. Lee
*Assistant Examiner*—Bernard E. Souw

(57) ABSTRACT

The invention describes an ion cyclotron resonance (ICR) mass spectrometer with an ICR trap, the ICR trap having as trapping electrodes two ion reflecting electrode structures operated by RF voltages without any DC voltage. The usual apertured ion trapping electrodes are replaced by multitudes of structural elements, electrically conducting, and repeating spatially in one or two directions of a surface, neighboring structure elements being connected each to different phases of an RF voltage. In the simplest case a grid of parallel wires can be used. The surface of such structures reflects ions of both polarities, if the mass-to-charge ratio of the ions is higher than a threshold.

14 Claims, 3 Drawing Sheets

ION CYCLOTRON RESONANCE MASS SPECTROMETER

FIELD OF THE INVENTION

The invention relates to the design of ion cyclotron resonance (ICR) traps in Fourier transform mass spectrometers (FTMS) wherein the mass-to-charge ratios of ions are measured by their cyclotron frequency in a strong magnetic field.

BACKGROUND OF THE INVENTION

In ion cyclotron resonance (ICR) mass spectrometers, the mass-to-charge ratio of ions is measured by the frequency of their cyclotron oscillations in a homogenous magnetic field of high field strength. The magnetic field is usually produced by superconducting magnet coils, offering usable diameters of homogenous field from four to eight inches. Modern ICR mass spectrometers operate at magnetic fields of 7 to 12 Tesla flux density.

The ion cyclotron frequency is measured in ICR traps mounted inside the magnetic field. The ICR trap consists of at least four lengthy outer electrodes parallel to the magnetic field lines. At least two of the electrodes are used to synchronously accelerate the cyclotron motion by application of an oscillating electric field in resonance with the cyclotron frequency of the ions; and at least two electrodes are used as probes for the cyclotron motion of the ions by measuring their image currents induced in those electrodes. Ion acceleration and ion detection are performed in subsequent phases. Because the mass-to-charge ratio of the ions is unknown before measurement, the resonant acceleration of the ions (their "excitation") is performed by a mixture of excitation frequencies. The mixture of frequencies can be produced either as a mixture in time (a "chirp pulse") or as a synchronous mixture of frequencies (a "sync pulse").

The image currents induced by the cyclotron motion of the ions at the probe electrodes ("detection electrodes") are amplified, digitized, and investigated by Fourier transformations with respect to inherent cyclotron frequencies indicating the presence of corresponding ions. The raw signals obtained at the probe electrodes are called the "time domain signals," and the Fourier transformed values are denominated "frequency domain signals," containing peaks for the frequencies of ions. From these frequencies, the mass-to-charge ratios of the ions can be calculated with high accuracy and precision. Because of the application of Fourier transform mathematics, these ICR mass spectrometers are called "Fourier transform mass spectrometers" (FTMS). At present, Fourier transform mass spectrometry is the most precise method for the measurement of ion masses.

The electrodes of an ICR trap usually form either a trap with a square or a circular cross section. Other shapes are occasionally used, too. Four plane electrodes with small electrically insulating distances form a square trap. A cylindrical trap is formed by four (or more) lengthy electrode segments forming a cylinder (see FIG. 2). Cylindric ICR traps are frequently used because they better make use of the full volume of the magnetic field.

Since the motion of ions parallel to magnetic field lines do not induce a Lorentz force, ions with a velocity component parallel to the magnetic field can easily escape the detection region. To prevent the loss of ions by this effect, the ICR traps have to be equipped at both ends by a pair of electrodes which are connected to an ion-repelling DC voltage to keep the ions inside the trap. These electrodes are usually called "trapping electrodes." Very different forms of trapping electrodes are known, but in the most simple case, the trapping electrodes are just plane electrodes ("trapping plates") with central holes. The central holes serve to introduce ions into the ICR trap. The repelling voltages at these trapping electrodes form a potential well along the axis of the ICR trap, only weakly dependent on the precise shape of the trapping electrodes. The potential well along the axis has the form of a parabola, with a minimum exactly in the center of the trap, if the trapping potentials applied to both the trapping electrodes are equal. Ions located in the axis of the trap, having some kinetic energy in the direction of the axis (left over from the process of entering the trap) oscillate between the trapping electrodes, the width of the "trapping oscillation" depending on their kinetic energy.

Outside the axis of the ICR trap, the electric field formed by the trapping electrodes is more complicated and necessarily shows electrical field components in radial direction, as the detection and excitation electrodes usually have no DC voltages. These field components induce another type of movement, the "magnetron" motion. The magnetron motion around the axis of the ICR trap is much slower compared to the cyclotron motion and leads the center of the fast cyclotron oscillation around the ICR trap axis on a magnetron circle, resulting in a cycloidal movement.

The superposition of the magnetron oscillation and the cyclotron oscillation is, in principle, a nasty effect introducing a frequency shift, diminishing the usable volume for the cyclotron movement, and reducing the mass resolution. The measured frequency $\omega_m$ ("reduced cyclotron frequency") of the ions amounts to $$\omega_m = \frac{\omega_c}{2} + \sqrt{\frac{\omega_c^2}{4} - \frac{\omega_t^2}{2}},$$

whereby $\omega_c$ is the cyclotron frequency, and $\omega_t$ is the frequency of the trapping oscillation, the latter describing the influence of the magnetron motion. An ICR trap without magnetron oscillation would be of big advantage, because the cyclotron frequency $\omega_c$ could be measured directly, and no corrections were needed.

The vacuum in the ICR trap should be as good as possible, because no collisions should occur during the measurement of the ion movements. Vacua in the range of $10^{-7}$ to $10^{-8}$ Pascal are usually applied. Usually, measurements of the time domain signals for the determination of the cyclotron frequency have durations from some hundred milliseconds to several seconds.

SUMMARY OF THE INVENTION

The invention describes an ion cyclotron resonance (ICR) mass spectrometer with an ICR trap, the ICR trap having two ion reflecting electrode structures as trapping electrodes, operated by RF voltages without any DC voltage. The usual apertured ion trapping electrodes are replaced by multitudes of structural elements, electrically conducting, arranged essentially in equal distances on a surface and repeating spatially in one or two dimensions of this surface, neighboring structure elements being connected each to different phases of an RF voltage. The surface of such electrode structures reflects ions of both polarities, if the mass-to-charge ratio of the ions is higher than a threshold. The threshold is proportional to the voltage, and inversely proportional to the distances of the structural elements, and to the square of the frequency of the RF voltage. The frequency of the RF voltage is chosen well above the range of ion cyclotron frequencies, in the range of 2 to 20 Megahertz, preferably at 5 to 10 Megahertz. The cross talk of the RF voltage onto the probe electrodes should be minimized by a suitable design of the structural elements and their connections to the RF generator.

The electrode structure is preferentially planar, but other shapes are possible, too. During the ion storage and measurement time, no DC potential is applied to reflect the ions, therefore no magnetron oscillations occur. The ions are purely reflected by strongly inhomogeneous RF fields around the structural elements. The reflective "pseudo potential" (also called "effective potential" or "quasi potential") of the inhomogeneous RF field around the structural elements has only very short penetration into the ICR trap, depending only on the spatial repetition distances of the structural elements.

In the simplest embodiment, the structure is just a fine grid made from thin parallel wires. Every other wire is connected to one phase of the RF voltage. Grids from free or surface mounted wires with 0.02 to 0.5 millimeter diameter, preferably with 0.2 millimeter diameter, and with distances from 0.2 to 2 millimeter, preferably of 0.5 to 1 millimeter, can be used. If no ions have to penetrate into the trap through these grids (e.g., if ions are generated inside the trap), very fine grids in the order of micrometers in thickness and distances can be made by microfabrication methods on glass or ceramic surfaces. With RF frequencies in the orders of some Megahertz and RF voltages of some ten Volts, reflecting pseudo potentials of some Volts are produced, capturing the ions inside the trap, without generating magnetron motions. In more complicated embodiments, arrays of pointed electrodes, or meshes with central pointed electrodes, can be used. Grids with wire circles or with wire spirals can be applied.

The ICR mass spectrometer with an ICR trap according to the invention shows several advantages over the prior art:

the trap is not producing magnetron oscillations, simplifying detection and mass calculation, and increasing mass resolution;

the trap can store positive and negative ions synchronously; and the trap has a much higher ion capacity: it can store much more ions before mass shifts and resolution losses appear due to space charge effects, because the ions are spread evenly in a much larger volume along the axis of the ICR trap.

BRIEF DESCRIPTION OF THE DRAWINGS

The above and further advantages of the invention may be better understood by referring to the following description in conjunction with the accompanying drawings in which.

DETAILED DESCRIPTION

Figure 1:
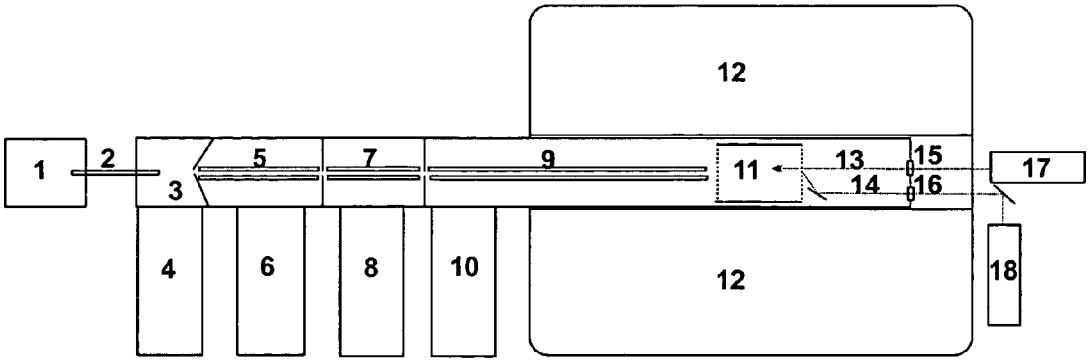
FIG. 1 presents a scheme of a FTMS mass spectrometer with an ICR trap (11) according to this invention inside a superconducting magnet (12)

A preferred embodiment is schematically shown in FIG. 1. Ions generated inside an ion source (1) are fed, together with ambient gas, through a capillary (2) into a first vacuum chamber (3) wherein a large portion of the gas is pumped away by the vacuum pump (4). In further differential pumping stages (5), (7), and (9), each with ion guide systems, more gas is pumped by pumps (6), (8), and (10). The ions enter the ICR trap (11) inside the superconducting magnet system (12) and are trapped by suitable procedures. The ion guide (7) may be used as a quadrupole filter for the selection of ions to be fragmented. The quadrupole filter (7) also may serve as ion storage unit, transferring ion bunches via ion guide (9) to the ICR trap (11). The infrared laser (17) may be used to fragment ions by IRMPD; the infrared photon beam (13) passes the infrared window (15). The UV laser (18) may be used to generate slow electrons by pulsed irradiation of the grid wires by the UV photon beam (14), passing the special UV-transparent window (16).

Figure 2:
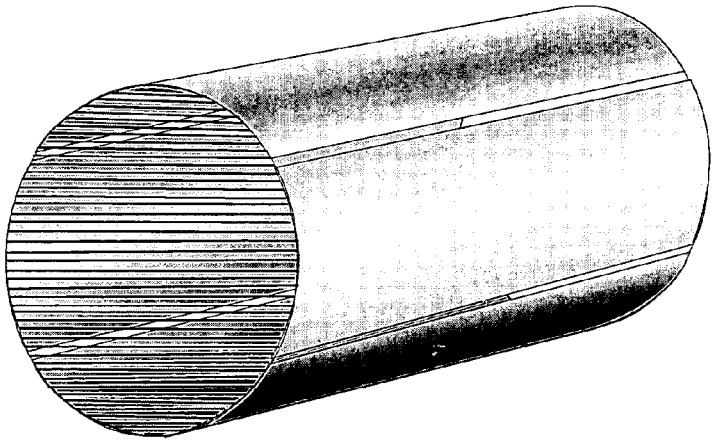
FIG. 2 exhibits the scheme of a cylindric ICR trap with a grid structure as trapping electrode at the front of the ICR trap.
Figure 3:
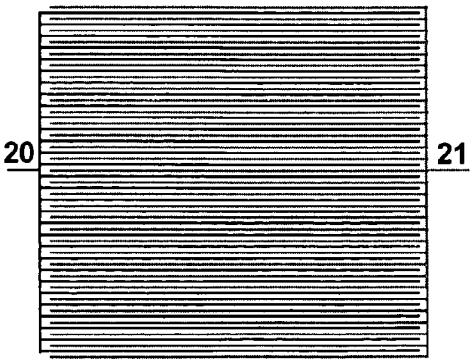
FIG. 3 shows a parallel wire grid with appropriate connections (20, 21)
Figure 4:
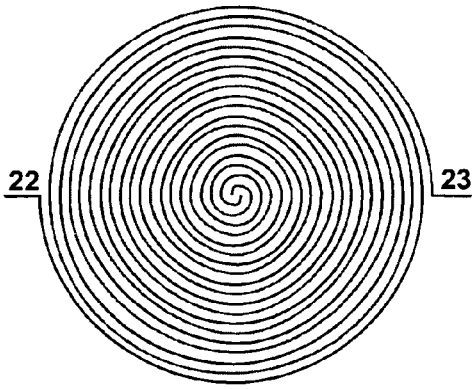
FIG. 4 presents a spiral wire grid with connections (22, 23) to the two phases of the RF voltage.

The cylindric ICR trap (11) of four lengthy electrodes is closed at both ends each by a fine grid structure, the grids being assembled from fine wires. FIG. 2 exhibits a scheme of such an ICR trap. The wires have to be connected to an RF voltage, every second wire to one phase of the RF voltage, as schematically shown in FIG. 3. Instead of an set of parallel wires, other types of grids may be used, for instance, a set of two spiral wires, as seen in FIG. 4.

Figure 6:
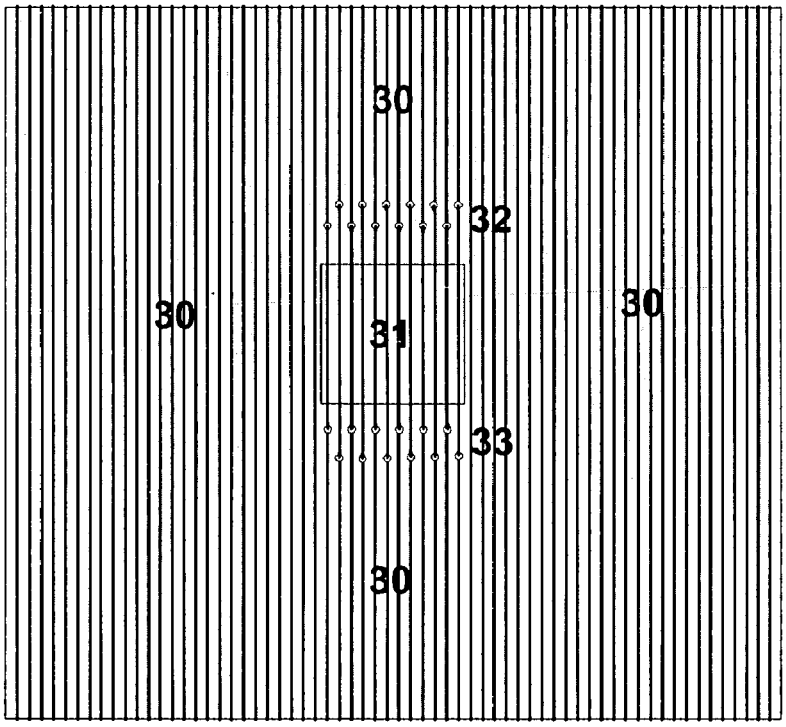
FIG. 6 shows an electronic printed circuit board with a printed grid structure at the outside area and free wires covering a central hole, for a square ICR trap.

As schematically shown in FIG. 6, parallel wires bridging the open hole (31) may be soldered onto a frame fabricated as a suitable electronic printed circuit board (30), feeding the RF voltage to the wires. The ions are fed to the ICR trap by a beam near to the axis of the ICR trap through the transparent and open part (31) of the electronic board. The opening (31) may be a rather small hole of about five millimeters to about one centimeter in the axis, bridged freely by the wires, whereas the board (30) supports the wires outside the hole. The wires not covering the small central hole, i.e. the wires sidewise from the holes in the areas (30), may even be replaced completely by printed structures on the printed circuit boards. The grid wires may only stretch from the soldering holes in rows (32) to the soldering holes in rows (33). The grid wires may even be glued to the board outside the central hole (31), resulting in a rather stable structure of trapping electrodes.

Instead of the usual polymer material used for printed circuit boards, other electrically isolating materials like quartz glass plates or special ceramics, e.g. machinable ceramics, may be used, if so required by vacuum or temperature conditions.

An RF field around the tip of a wire drops in field strength proportional to $1/r^2$, the RF field of a long, thin wire drops with $1/r$, where r is the distance to the wire tip, or to the wire axis. Both fields reflect positively or negatively charged particles. The particle oscillates in the RF field. Independent of its polarity, it encounters its largest repelling force exactly when it is located in its position nearest to the wire, that is the point of strongest field strength during the oscillation. It encounters its strongest attracting force exactly in its location farthest from the wire, i.e., in the point of lowest field strength during its oscillation. Integrated over time, a repelling force results. This time-integrated repelling force field often is called "pseudo force field", described by a "pseudo potential distribution" (or "effective potential", or "quasi potential", as explained above). The pseudo potential is proportional to the square of the RF field strength; it drops with $1/r^4$ in case of the tip, and with $1/r^2$ in case of the long wire, but is, in addition, inversely proportional to both the particle mass m and the square $\omega^2$ of the RF frequency $\omega$.

The surface produced from parallel wires forms an RF field which also has a rather short penetration into the space above the surface. The field drops almost exponentially in front of a large area of wires. With a field strength F at the surface of a single wire, having a diameter of 1/10 of the wire distance D, the field drops to 5% of F in a distance of D above the surface, to 0.2% of F in a distance 2D, and to a field strength of only 0.009% of F in a distance of 3D. The pseudo potential of this RF field, being proportional to the square of the field strength, drops even much stronger, for instance to about 0.25% in a distance of D, as can be seen from FIG. 5.

Figure 5:
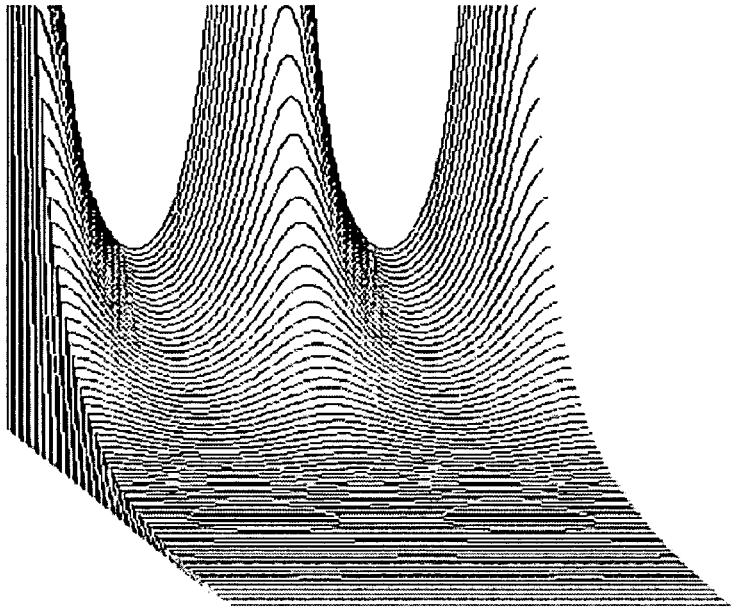
FIG. 5 presents the pseudo potential of three vertical wires of a grid connected to RF voltages.

FIG. 5 exhibits the pseudo potential around three wires out of a grid of parallel wires, calculated mathematically. The pseudo potential exhibits saddle points between the wires; ions with sufficient kinetic energy to climb the saddle points may pass the grid, and usually are deflected a little sideways on the other side by the shape of the pseudo potential, resulting in small cyclotron movements. Ions not having sufficient kinetic energy to surmount the saddle points between the wires, are reflected, suffering some sideward stray reflection, also resulting in small cyclotron movements.

Depending on the ratio between the wire diameters and the distances between the wires, some ten volts peak-to-peak RF voltage of five megahertz is needed to produce a reflecting pseudo potential of some volts. The pseudo potential is mass dependent, it is inversely proportional to the mass-to-charge ratio of the ions. The pseudo potential also depends on the RF frequency: the reflecting pseudo potential decreases inversely proportional to the square of the frequency.

A method to operate an ion cyclotron resonance mass spectrometer with ions not performing magnetron movements can be defined by the following steps, very similar to usual operation:

(a) providing a strong homogeneous magnetic field,
(b) providing the ICR trap according to the invention within the strong magnetic field,
(c) providing an RF voltage to the ion reflecting structures at both ends of the ICR trap,
(d) filling the ICR trap with a number of ions,
(e) exciting the ions to cyclotron resonance movements by a mixture of RF voltages at the excitation electrodes of the ICR trap,
(f) measuring the mirror currents of the ion cyclotron movements induced in the probe electrodes of the ICR trap,
(g) digitizing the induced currents, and
(g) applying a Fourier transformation to the measurement values to get the frequency signals of the ions, from which the ion mass-to-charge ratios can be calculated.

As filling proceeds, almost any process used hitherto can be used if the RF is disconnected during the filling process and replaced by DC voltages at the grid structure of the trapping electrodes. In this case, the filling process is restricted to ions of one polarity only. The magnetron motion of the ions disappears as soon as the DC voltage at the trapping electrodes is replaced by the RF voltage.

The ICR trap may however be filled with externally generated ions directly through the grid structure operated with RF voltage. This filling process is even easier than the processes known from ICR traps according to prior art. While the RF voltage at the grid opposite to the entrance side is kept at its normal reflecting operation voltage, the RF voltage at the entrance grid is decreased to a value which allows an ion beam, directed towards the entrance grid rectangularly from the outside, to pass the saddle points of pseudo potential between the grid wires. If the ions of the ion beam have sufficient kinetic energy, a large part of the ions of the beam will enter the ICR trap, only a small part will be reflected and gets lost. Most of the entering ions will encounter small sideward deflections during the entering process by the pseudo field changing in strength and direction along the surface, as can be seen from FIG. 5. The ions deflected sidewise are forced to helical movements with small radius and cyclotron frequency. Because the kinetic energy of the ions is preserved, the helical movement splits the velocity of an ion into a forwards (axial) velocity towards the opposite grid, and a circular velocity. The kinetic energy in the axial direction towards the opposite grid becomes therefore somewhat smaller. On arrival at the opposite grid, the ions are reflected by the pseudo potential, and are again irregularly deflected sideways. Again the ions perform helical movements on their way back, the helical movements in the average even being narrower in pitch. On arrival at the entrance grid, for energy and angular reasons the helical movement does not allow to pass the pseudo potential saddle points for the overwhelming part of the ions, these ions are firmly trapped inside the ICR trap.

The angularly straying reflection can be increased by a special form of the ion reflecting structure: if small strips with rows of pointed protrusions are put together, a grid of pointed protrusions in shape of an squared pattern of protrusions can be formed. This structure reflects the ions into all spatial directions.

Usually, the ions for filling the ICR trap are stored first in some distance from the ICR trap, for instance in the quadrupole filter (7) of FIG. 1, and then are accelerated with very low voltages in the order of 1.5 to 3 Volts towards the ICR trap (11) to enter. In this case, the path towards the ICR trap forms a kind of time-of-flight mass spectrometer: the ions with low mass-to-charge ratio arrive first, the heavier ions follow later. Because the heights of the pseudo potentials are inversely proportional to the mass-to-charge ratios (or to the square of the frequency), this effect can be used for a very favorable filling process. At first, the RF voltage at the entrance grid is tuned to a very low value so that ions of low mass-to-charge ratio can just overcome the pseudo potential barrier. With the arrival of ions with higher mass-to-charge ratios, the RF voltage is continuously increased (or the RF frequency is decreased), still just allowing the now heavier ions from outside to enter, but forbidding the lighter ions inside to escape. This filling process is very effective and minimizes losses of ions.

Modern FTMS instruments are equipped with vacuum-external ion sources (1) such as electrospray ionization (ESI), atmospheric pressure chemical ionization (APCI), atmospheric pressure photon ionization (APPI), or atmospheric pressure matrix-assisted laser desorption and ionization (AP-MALDI). The ions are fed into the vacuum system by a suitable capillary (2); the ions are guided towards the mass spectrometer via several differential pumping stages by ion guides (5), (7), (9). In most cases, a quadrupole filter (7) is somewhere contained in the ion path, capable to select ions of a certain range of mass-to-charge ratios. Instruments of this kind are designated as QFTMS. Sometimes a quadrupole collision trap is inserted, too, these instruments are abbreviated QqFTMS (not shown). The quadrupole collision trap downstream from the selective quadrupole filter serves to fragment selected ions in order to measure the fragment ion spectrum, often called a daughter ion spectrum, of a selected parent ion species.

If ions of a selected species are introduced into the ICR trap (11), they can also be fragmented inside the ICR trap (11) instead of being fragmented in a special collision trap. There are two very effective fragmentation methods for fragmenting the ions inside the ICR trap, both operate without collision gases, saving the collision gas and keeping the vacuum clean and in best conditions for the cyclotron frequency measurement. These two fragmentation methods inside the ICR trap are named (1) infrared multiphoton dissociation (IRMPD) and (2) electron capture dissociation (ECD). For negative ions, electron detachment dissociation (EDD) can be used instead of ECD.

IRMPD can be used inside the ICR trap (11) according to the present invention in the usual manner by just directing an infrared laser beam (13) from an infrared laser (17) along the axis of the ICR trap (11), offering an surplus of infrared photons to be absorbed by the ions, eventually leading to fragmentation. This IRMPD type of fragmentation gives spectra similar to collisionally induced dissociation (CID).

ECD is a completely different fragmentation process, delivering different and widely complementary information about the structure of molecules, as a rule very favorable information about the sequence of biopolymers. The process starts from multiply charged positive ions, generally from doubly charged ions, as generated in electrospray ionization. The fragmentation process is induced by the capture of low energy electrons; electrons in the kinetic energy range of a few electronvolts only. In usual FTMS instruments, these ions are generated by a hot cathode inside the strong magnetic field, and the electrons drift slowly towards the cloud of ions in the axis of the ICR trap.

With ICR traps according to the present invention, this generation process can be used as long as the RF voltages at the trapping electrodes are not too high. With moderate RF voltages, the electrons from a hot cathode can simply pass the ion reflecting structure of the trapping electrodes, because the electrons are bound to follow the magnetic field lines, and their cyclotron radii influenced by the wire voltages amount only to tenths of a millimeter in maximum. In addition, it is possible to generate electrons by pulses of an ultraviolet (UV) laser direct on the wires of the trapping electrodes, hitting the wires under a certain angle from behind, as shown in some detail in FIG. 7, or passing the ICR trap and hitting the opposite wire grid from the inside of the ICR trap.

Figure 7:
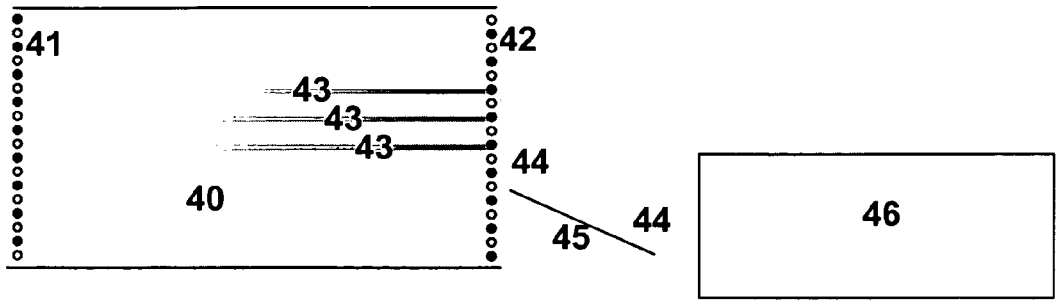
FIG. 7 presents, as a scheme, the generation of beams (43) of slow electrons by pulsed irradiation of grid wires (42) by a pulsed UV laser (46)
Figure 8:
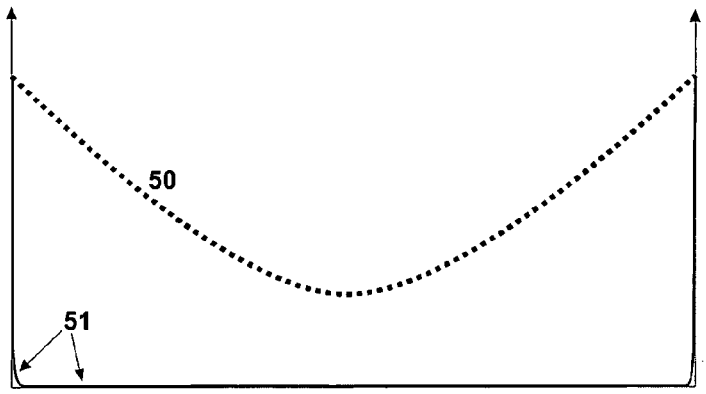
FIG. 8 shows the parabolic trapping potential (50) along the axis of the ICR trap for the state of the art and the flat pseudo potential trough (51) for the ICR trap according to this invention.

In FIG. 7, the UV laser (46) sends pulses of UV light beams (44) via a mirror (45) to the wires (42) of the trapping electrode grid. The UV quanta release electrons (43) from the wires, the kinetic energy of which depends on the momentary voltage of the RF voltage at the grid. The UV laser pulses have to be triggered to hit the wires (42) in phases of the RF voltage, where the voltages are very near to zero. By tuning the phase angle between RF phases and laser pulse, the kinetic energy of the electrons can be varied and tuned to optimum fragmentation efficiency. The material of the wires should be selected for a low electron emission work function.

For the release of the electrons either simple and cost effective nitrogen lasers (337 nanometers) or Neodymium-YAG lasers can be used in frequency quadrupled mode (226 nanometers). Both types of lasers deliver UV light pulses in the order of a few nanoseconds, sufficient to release a bunch of electrons in the right phase angle to make the electrons leave slightly negatively charged wires with a few electron volts energy before the RF voltage of the grid recovers and removes the electrons by wires with positive voltage.

Another method of fragmenting the ions by electron capture dissociation is more similar to the usual way of ECD in FTMS: a usual hot cathode is used to generate the electrons in the axis of the ICR trap, but outside the trap. The trapping electrode grids are then disconnected from the RF voltage, and a positive DC voltage of about 1.5 Volts at the trapping electrode grids is used instead for the trapping of the ions. The electrons move strictly along the magnetic field lines towards the grid, accelerated somewhat by the trapping electrode grid; they pass the grid, and partly react with the ions inducing fragmentation. After the reaction time the grid structures of the trapping electrodes are immediately reconnected to the RF voltage.

Figure 9:
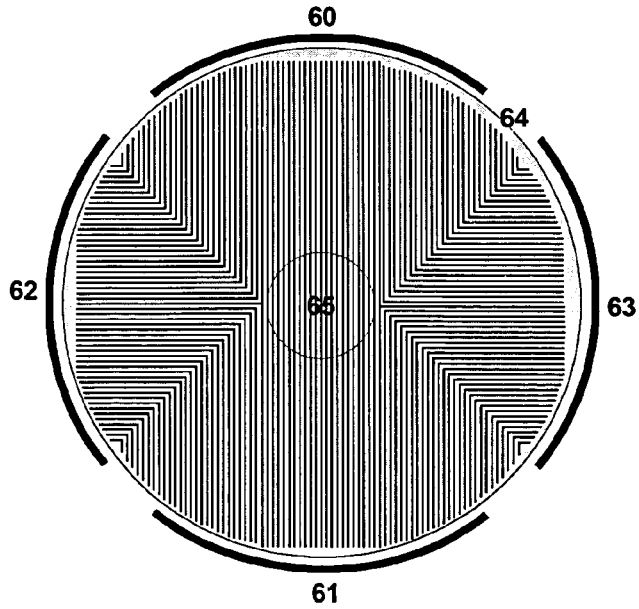
FIG. 9 exhibits an ICR trap arrangement with low RF cross talking onto the probe electrodes (60) and (61).

A problem may arise from cross talking of the RF voltage of the trapping electrode structure onto the probe electrodes which measure the induced mirror voltages of the cycling ions. These image voltages amount to microvolts only. Therefore, the cross talk of the RF must be minimized. By suitable symmetrical structures for both RF phases, as for instance shown in FIG. 9, and by using twisted and shielded RF connections, the cross talk can be minimized to millivolts. In addition, the RF frequency can be chosen outside the range of cyclotron frequencies; in this case, the RF frequency can be filtered electronically from the time domain signal before digitizing, or even filtered out from the digitized values by suitable mathematical algorithms. The RF frequency, however, should not be selected too high, otherwise the RF voltage has to be chosen very high because the pseudo potential is proportional to the voltage, but inversely proportional to the square of the RF frequency.

With the knowledge of this invention, the specialist in FTMS mass spectrometry can tailor his own ICR trap design and analytical measuring methods according to the special needs of his analytical task.

What is claimed is:

1. Fourier transform mass spectrometer comprising an ICR trap within a magnetic field, the ICR trap containing trapping electrodes that trap ions relative to ion motion along an axis of the trap parallel to lines of the magnetic field, the electrodes comprising a multitude of structural elements, arranged in about equal distances on a surface and repeating spatially in one or two dimensions, with neighboring structural elements being connected each to different phases of an RF voltage, so that ions of both polarities are reflected by the trapping electrodes.

2. Fourier transform mass spectrometer according to claim 1, wherein the multitude of structural elements of the trapping electrode are arranged in a plane.

3. Fourier transform mass spectrometer according to claim 2, wherein the multitude of structural elements are fine wires forming a grid, with any other wire being connected to one phase of the RF voltage.

4. Fourier transform mass spectrometer according to claim 3, wherein the multitude of structural elements is formed by straight parallel wires.

5. Fourier transform mass spectrometer according to claim 1, wherein the multitude of structural elements is fastened on an electrically insulating surface.

6. Fourier transform mass spectrometer according to claim 5, wherein the electrically insulating surface has a central aperture, and wherein the aperture is bridged by wires.

7. Fourier transform mass spectrometer according to claim 1, wherein the multitude of structural elements is formed by two concentric wire spirals.

8. Fourier transform mass spectrometer according to claim 1, wherein the multitude of structural elements is formed by concentric wire rings.

9. Fourier transform mass spectrometer according to claim 1, wherein the multitude of structural elements is at least partially formed by printed structures on a printed circuit board, or by microfabrication on insulator surfaces.

10. Fourier transform mass spectrometer according to claim 9, wherein the multitude of structural elements is formed by a mixture of printed structures on a printed circuit board, and by wires soldered to the printed circuit board.

11. Fourier transform mass spectrometer according to claim 1, wherein the RF voltage at the trapping electrodes can be temporarily replaced by DC voltages.

12. Fourier transform mass spectrometer according to claim 1, additionally comprising within the magnetic field a hot cathode to generate low energy electrons.

13. Fourier transform mass spectrometer according to claim 1, additionally comprising an infrared laser for infrared multiphoton dissociation (IRMPD) of the ions stored in the ICR trap.

14. Fourier transform mass spectrometer according to claim 1, additionally comprising a pulsed UV laser to release electrons from the ion reflecting electrode structure for dissociating stored ions inside the ICR trap by electron capture.

* * * * *